US006512532B2

(12) United States Patent
Sako et al.

(10) Patent No.: US 6,512,532 B2
(45) Date of Patent: Jan. 28, 2003

(54) THERMAL PRINTHEAD, HEATING RESISTOR USED FOR THE SAME, AND PROCESS OF MAKING HEATING RESISTOR

(75) Inventors: Teruhisa Sako, Kyoto (JP); Toshiyuki Fujita, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/930,203

(22) Filed: Aug. 16, 2001

(65) Prior Publication Data

US 2002/0030729 A1 Mar. 14, 2002

(30) Foreign Application Priority Data

Aug. 17, 2000 (JP) ..... 2000-247152

(51) Int. Cl.[7] ..... B41J 2/335
(52) U.S. Cl. ..... 347/204
(58) Field of Search ..... 347/204, 206; 252/514, 518.1, 519.1, 519.12, 519.13; 427/58

(56) References Cited

U.S. PATENT DOCUMENTS 4,603,007 A * 7/1986 Shibata et al. ..... 252/514
4,849,605 A * 7/1989 Nakamori et al. ..... 219/216

FOREIGN PATENT DOCUMENTS

JP 9-17605 * 1/1997 ..... H01C/7/00

* cited by examiner

*Primary Examiner*—Huan Tran
(74) *Attorney, Agent, or Firm*—Michael D. Bednarek; Shaw Pittman LLP

(57) ABSTRACT

A thermal printhead includes a substrate, an electrode layer formed on the substrate, and a heating resistor which is formed on the electrode layer and contains a conductive substance and glass. The conductive substance of the heating resistor is doped in advance with an insulating substance which is identical in crystalline structure to the conductive substance. The heating resistor is formed by mixing powder of the insulating substance, which is identical in crystalline structure to the conductive substance, with the conductive substance powder, baking the obtained mixture, pulverizing the baked mixture, mixing the pulverized mixture with glass powder to prepare a resistor paste, and printing and baking the obtained resistor paste.

12 Claims, 6 Drawing Sheets

THERMAL PRINTHEAD, HEATING RESISTOR USED FOR THE SAME, AND PROCESS OF MAKING HEATING RESISTOR

BACKGROUND OF THE INVENTION

1. Field of the Invention

The present invention relates to a thermal printhead for performing printing on a recording medium thermosensitively or by thermal transfer. The present invention also relates to a heating resistor used for a thermal printhead and a process of making a heating resistor.

2. Description of the Related Art

As is well known, a thermal printhead is used for selectively applying heat to a recording medium such as thermosensitive paper or a heat transfer ink ribbon to form necessary images. Thermal printheads are generally divided into thick-film thermal printheads and thin-film thermal printheads depending on the method of forming a heating resistor which generates heat when energized.

Referring to FIGS. 1 and 2, the structure of a prior art thermal printhead is described. The thermal printhead comprises a substrate 1 made of an alumina ceramic material for example and a glaze layer 2 for heat retention. The glaze layer 2 is formed with a common electrode 3 and individual electrodes 4 and is provided with a plurality of drive ICs 9 mounted thereon.

The common electrode 3 includes comb-teeth 5 and a common line 6 connecting the comb-teeth 5 to each other. Each of the individual electrodes 4 extends into a space between two adjacent comb-teeth 5. A heating resistor 7 is formed on and across the comb-teeth 5 and the individual electrodes 4. The heating resistor 7 is covered with a protective layer 8. The individual electrodes 4 are connected to the drive ICs 9 via wires 10 made of gold for example.

In the thermal printhead having the above-described structure, when a current is applied across two comb-teeth 5 between which an individual electrode 4 is arranged, part of the heating resistor 7 located between these two comb-teeth 5 is heated. As a result, one dot of an image is printed on a thermosensitive paper for example.

The heating resistor 7 contains a conductive substance such as ruthenium oxide and an insulating substance such as glass for example. Conventionally, for forming a heating resistor 7, a resistor paste is first prepared by mixing powder of a conductive substance with powder of glass, followed by further mixing therewith a resin, a solvent, and if necessary a filler for enabling printing. Subsequently, the resistor paste is applied on the substrate 1 into a strip. Then the resistor paste is dried, and baked at a temperature of about 810° C. for example.

In forming the heating resistor 7, glass is mixed for the purpose of strongly bonding the heating resistor 7 onto the substrate 1 and for making the heating resistor 7 into a desired configuration. Moreover, by changing the mixing ratio of the glass to the conductive substance, it is possible to adjust the electric resistance of the heating resistor 7. The heating resistor 7 made by the above-described process has a structure wherein particles of the conductive substance are connected to each other in various directions so as to fill spaces between glass particles.

The electric resistance of the heating resistor 7 is determined in advance considering the use conditions of a thermal printhead, and the heating resistor 7 is so made as to provide the predetermined electric resistance. However, the voltage applied to the thermal printhead may vary depending on the kind and specifications of a printer, a facsimile machine or the like incorporating it. Therefore, in a thermal printhead, it is necessary to adjust the electric resistance in accordance with the voltage to be applied.

As described above, the adjustment of electric resistance is performed by changing the mixing ratio of glass and a conductive substance. For example, to decrease the electric resistance, the content of the conductive substance is increased. Conversely, to increase the electric resistance, the content of the conductive substance is decreased.

Generally, with respect to a heating resistor 7 of a thermal printhead, a heating resistor of a relatively high electric resistance (no less than 800Ω for example) has a shorter life than a heating resistor of a relatively low electric resistance (less than 800Ω for example) for the following reasons.

In a heating resistor with a low electric resistance, the content of the conductive substance is high so that many thick conductor paths are formed in a network fashion. When current flows through the low resistance heating resistor, electrons migrate between the particles of the conductive substance while generating heat. The heat melts the glass around the conductive substance particles, causing the so called "thermal breakdown" of the glass. In this way, a low resistance heating resistor breaks and ends its life mainly because of such thermal breakdown of the glass.

On the other hand, in a heating resistor with a high electric resistance, the content of the conductive substance is low so that the content of the glass is complementally high. Therefore, conductive paths are relatively thin and small in number. Therefore, even before the heating resistor is heated, the conductive path may be locally broken, which leads to breakdown of the heating resistor. For this reason, a high resistance heating resistor has a shorter life than a low resistance heating resistor of. Thus, there is a demand for a heating resistor which has a high electric resistance and also has a long life.

One of the operating characteristics of a heating resistor in a thermal printhead is endurable power. The endurable power indicates the magnitude of energy endured by a heating resistor when a current passes the heating resistor. For example, the endurable power may be expressed by the magnitude of electric energy at which the electric resistance of the heating resistor varies from its inherent value by no less than 15%. Therefore, a heating resistor having a greater endurable power provides less resistance variation and is therefore preferable for practical use.

The endurable power may be measured by a breakdown test called SST (step stress test). In this test, a pulse voltage of a given frequency is applied to a heating resistor while gradually changing the voltage as time elapses, wherein the change of the electric resistance is measured until the heating resistor breaks. While increasing the electric power in this test, the electric resistance once drops before the heating resistor breaks. This phenomenon is called "minus drift". The minus drift occurs partly because of insufficient dispersion of the conductive substance in the heating resistor; i.e. the conductive substances are dispersed unevenly in the glass. The minus drift results in too black printing.

FIG. 3 illustrates the relationship between applied power and resistance variation ratio in SST when a heating resistor with a high sheet resistance of about 1.15 kΩ (sheet resistance: resistance value for a square sheet having a thickness of 10 $\mu$m and a side length of 3 mm) is activated for 32 dots. According to this figure, a minus drift occurs when the applied power becomes close to 0.8W. Such a minus drift is more likely to occur in a heating resistor having a lower content of conductive substance and hence a higher resistance than in a heating resistor with a higher content of conductive substance. This is because a heating resistor with a low electric resistance contains a large number of conductive particles, so that even if dispersion of the conductive particles is insufficient, it is possible to evenly disperse the conductive substance and glass. Therefore, a minus drift is less likely to occur.

On the other hand, in a heating resistor having a high electric resistance due to a low content of conductive substance, the number of conductive particles is small so that glass and the conductive substance cannot be easily dispersed evenly. For this reason, a minus drift is likely to occur. Therefore, there is a demand for a heating resistor which has a high electric resistance and is capable of preventing a minus drift.

Summary of the Invention

It is therefore an object of the present invention to provide a heating resistor for a thermal printhead, which has a high resistance and a relatively long life but yet is capable of preventing minus drift.

Another object of the present invention is to provide a thermal printhead using such a heating resistor.

Still another object of the present invention is to provide a process of making such a heating resistor.

For achieving the objects described above, the present invention adopts the following measures.

In accordance with a first aspect of the present invention, there is provided a heating resistor for a thermal printhead, which contains a conductive substance and glass. The conductive substance is doped with an insulating substance which is identical in crystalline structure to the conductive substance.

Preferably, the conductive substance may comprise ruthenium oxide, and the insulating substance may comprise titanium oxide. Further, the content of titanium oxide in the titanium-oxide-doped ruthenium oxide may be 1–10 wt % (particularly 1–5 wt %).

In accordance with a second aspect of the present invention, there is provided a thermal printhead comprising a substrate, an electrode layer formed on the substrate, and a heating resistor which is formed on the electrode layer and contains a conductive substance and glass. The conductive substance is doped with an insulating substance which is identical in crystalline structure to the conductive substance.

In accordance with a third aspect of the present invention, there is provided a process of making a heating resistor for a thermal printhead comprising the steps of preparing a resistor paste by mixing powder of a conductive substance and glass powder, printing the resistor paste into a film, and baking the printed resistor paste. The method further comprises, before mixing the conductive substance powder with the glass powder, the steps of mixing powder of an insulating substance with the conductive substance powder, baking the obtained mixture, and pulverizing the baked mixture. The insulating substance is identical in crystalline structure to the conductive substance;

Preferably, the conductive substance comprises ruthenium oxide, whereas the insulating substance comprises titanium oxide. In this case, it is preferable that 1–10 wt % of titanium oxide is mixed with 99–90% of ruthenium oxide.

Other features and advantages of the present invention will become clearer from the detailed description given below with reference to the accompanying drawings.

DETAILED DESCRIPTION OF THE PREFERRED EMBODIMENTS

Preferred embodiments of the present invention will be described below in detail with reference to accompanying drawings.

Figure 1:
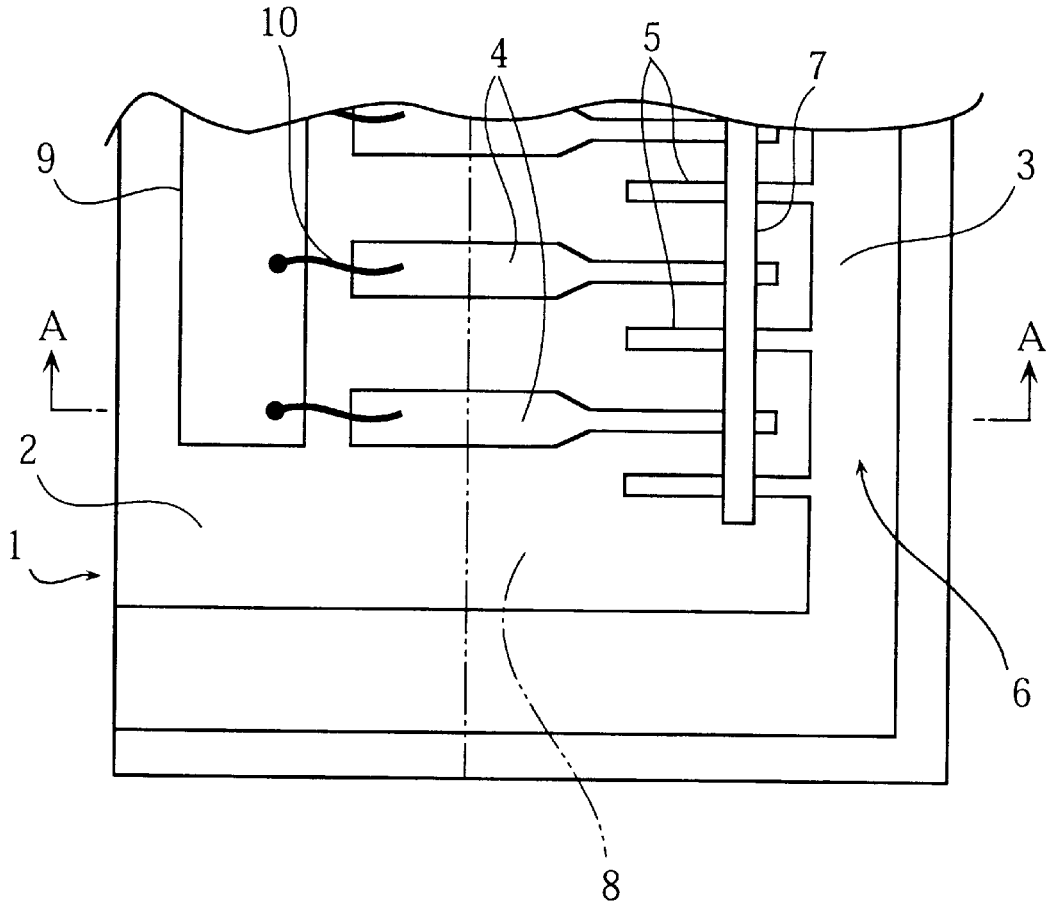
FIG. 1 is a plan view illustrating a principal portion of a thermal printhead according to the present invention.
Figure 2:
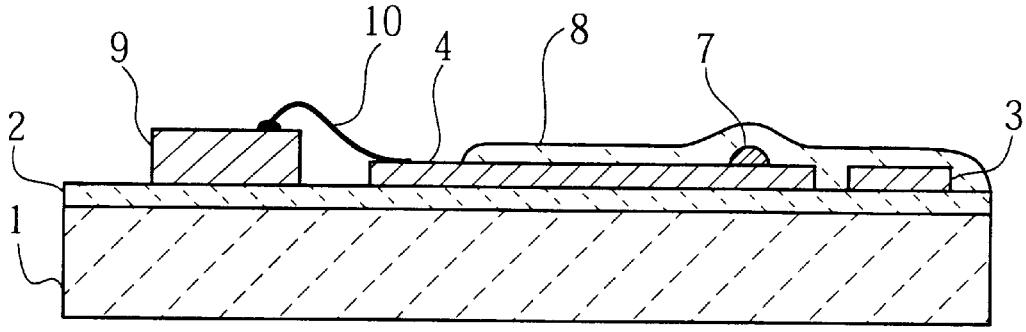
FIG. 2 is a sectional view taken on lines A—A in FIG. 1.
Figure 3:
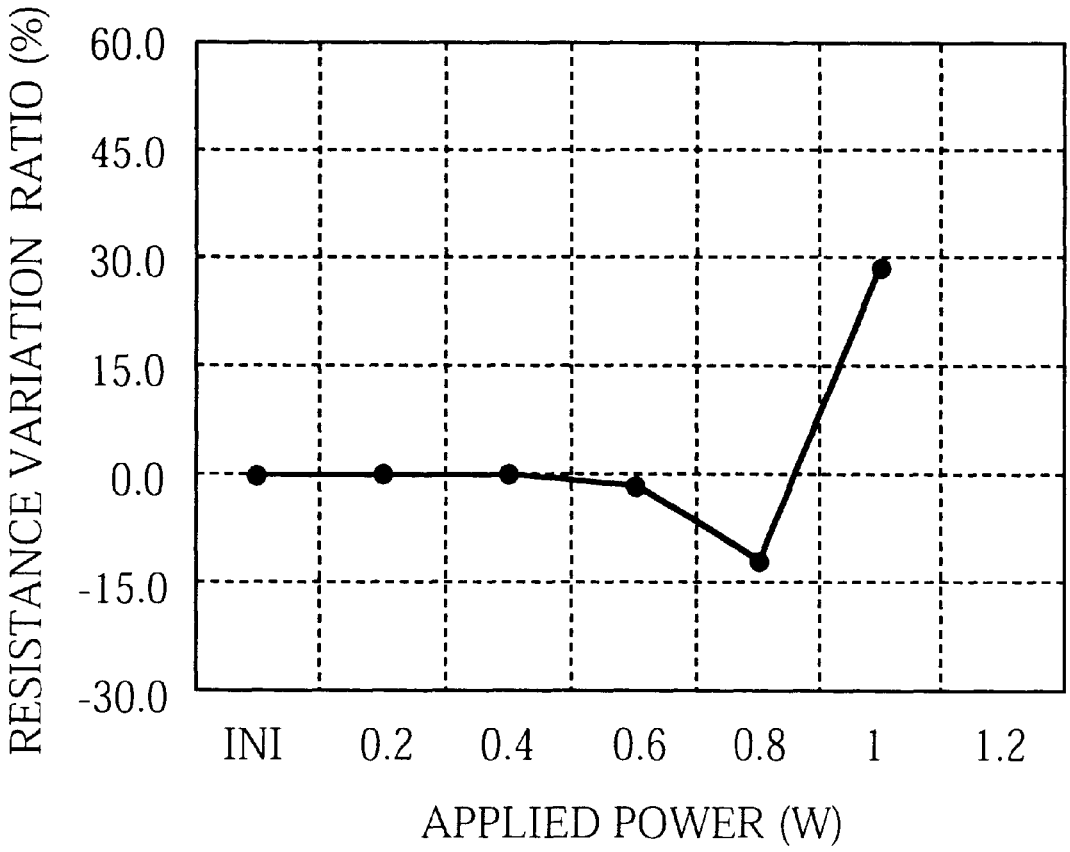
FIG. 3 is a graph showing the relationship between applied power and resistance variation ratio in a prior art heating resistor.

A thermal printhead embodying the present invention is identical in apparent structure to the prior art thermal printhead shown in FIGS. 1 and 2. The thermal printhead includes a substrate 1 comprising a generally flat plate made of an insulating material such as alumina ceramic material, and a glaze layer 2 mainly composed of glass for covering the entire upper surface of the substrate 1 to serve as a heat retaining layer. The glaze layer 2 is formed, on the upper surface thereof, with a common electrode 3 and a plurality of individual electrodes 4.

The common electrode 3 includes comb-teeth 5 each extending widthwise of the substrate 1 and a common line 6 connecting the comb-teeth 5 to each other. The comb-teeth 5 and the individual electrodes 4 are alternately arranged substantially throughout the entire length of the substrate 1. The comb-teeth 5 and the individual electrodes 4 are traversed by a heating resistor 7 which generates heat when a voltage is applied across the common electrode 3 and the individual electrodes 4. The heating resistor 7 is in the form of a strip extending longitudinally of the substrate 1 across and in contact with the comb-teeth 5 and the individual electrodes 4. The composition of the heating resistor 7 will be detailed hereinafter.

The heating resistor 7, the comb-teeth 5 and part of each individual electrode 4 are covered with a protective layer 8. The protective layer 8 functions to protect the heating resistor 7, the comb-teeth 5 and the individual electrodes 4. The protective layer is made of an abrasion-resistant material such as hard glass.

Further, a plurality of drive ICs 9 (only one of which is shown) are mounted on the glaze layer 2 as aligned longitudinally of the substrate 1. Each of the drive ICs 9 controls power supply to the heating resistor 7 in accordance with the print data. Each drive IC takes charge of a predetermined number of individual electrodes 4. The drive IC is electrically connected to the individual electrodes 4 via bonding wires 10 made of gold for example.

When one of switching elements (not shown) incorporated in the drive IC 9 correspondingly to the respective individual electrodes 4 is turned on, a closed loop is formed which consists of the anode (not shown) of the power source, the common electrode 3 (including the comb-teeth 5), the heating resistor 7, the individual electrode 4, the wire 10, the switching element of the drive IC, and the cathode (not shown) of the power source. As a result, current flows through a portion of the heating resistor 7 between two comb-teeth 5 sandwiching one individual electrode 4, so that heat is generated at that portion.

Next, a method for making the above-described thermal printhead is described.

First, a glass paste is printed on a substrate 1, which is made of an alumina ceramic material, and then baked at a temperature of about 1200° C. for example to provide a glaze layer 2.

Subsequently, resinated gold is printed on the upper surface of the glaze layer 2 and baked to provide a conductive layer. Thereafter, unnecessary portions of the conductive layer are removed by etching for example to form individual electrodes 4 and a common electrode 3.

Then, a heating resistor 7 is formed on the individual electrodes 4 and comb-teeth 5. The heating resistor may be made of a resistor paste obtained by mixing a conductive substance containing powder of ruthenium oxide ($RuO_2$), an insulating substance comprising glass powder, a resin and a solvent for example.

In this embodiment, titanium oxide ($TiO_2$) which is an insulating substance and is identical in crystalline structure (e.g. rutile structure) to that of ruthenium oxide is added to the conductive substance, i.e. ruthenium oxide in a predetermined weight ratio.

Figure 4:
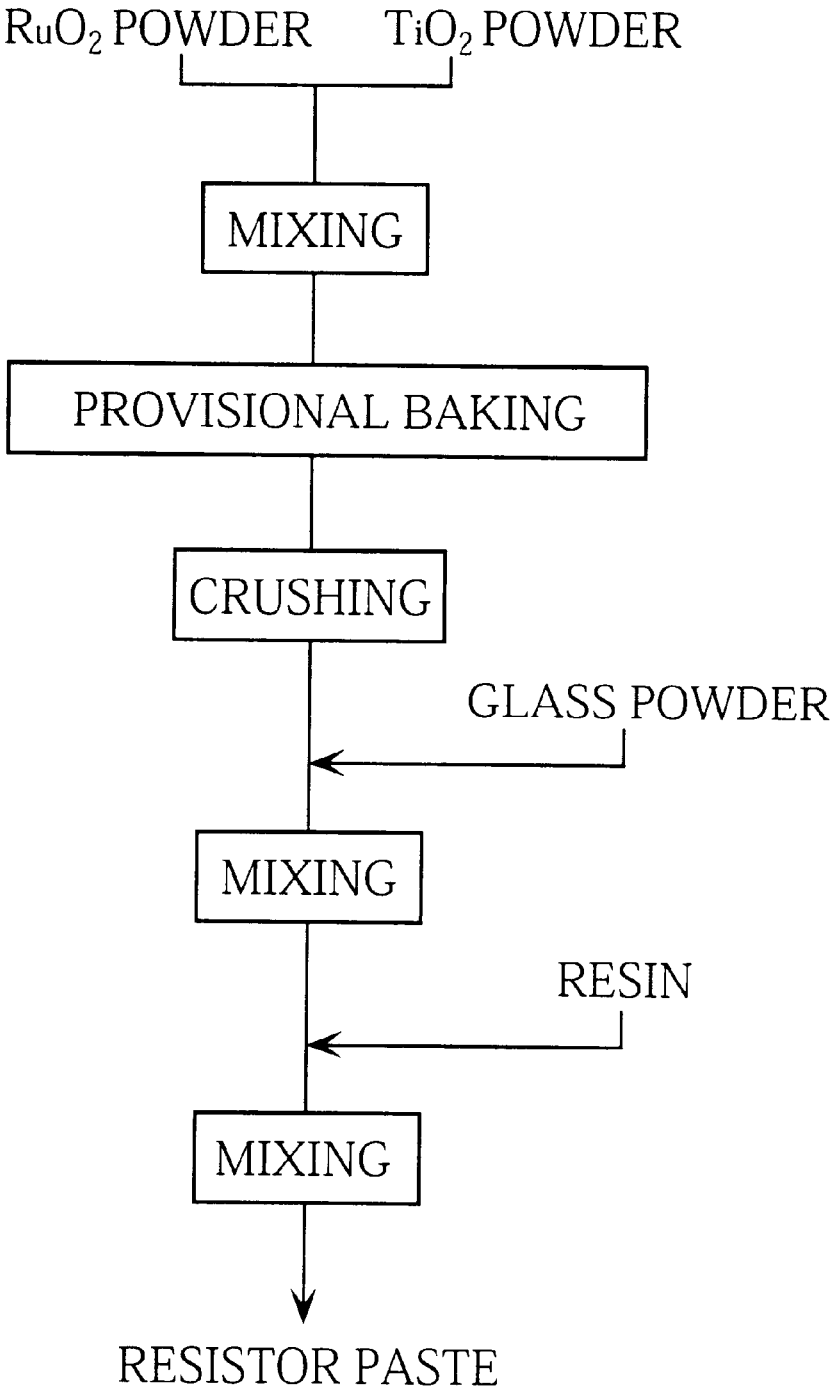
FIG. 4 illustrates process steps for making a resistor paste.

Next, the process steps of preparing the resistor paste will be described in detail with reference to FIG. 4.

First, titanium oxide powder is mixed with ruthenium oxide powder in a predetermined weight ratio (for example 1–10%, and preferably 1–5%).

Figure 5:
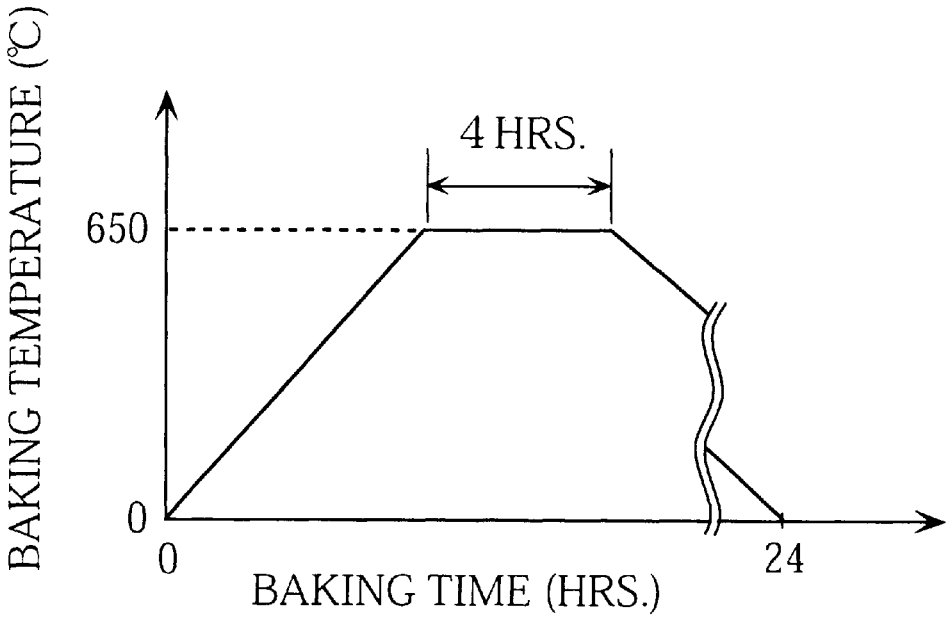
FIG. 5 is a graph showing the relationship between baking temperature and baking time in provisionally baking ruthenium oxide and titanium oxide.

Subsequently, the mixture of ruthenium oxide and titanium oxide is baked for a predetermined period of time (hereinafter referred to as "provisional baking"). As shown in FIG. 5, the provisional baking is performed over a period of 24 hours. Specifically, the baking temperature for the mixture is gradually increased up to 650° C. and held at that temperature for about four hours for continuing baking at that temperature. Thereafter, the temperature is gradually decreased so that the total baking period becomes about 24 hours.

After the mixture of ruthenium oxide and titanium oxide is provisionally baked, the mixture is pulverized into powder again.

Subsequently, glass powder is mixed with the provisionally baked mixture powder. The glass powder used may be Pb-Si-B-Al-Ca-Ba-Mg non-crystalline glass and may have an average particle size of 1 $\mu$m for example.

For making a heating resistor 7 which exhibits a high resistance, the mixing ratio of titanium-oxide-doped ruthenium oxide relative to the glass is set low. Specifically, for making a heating resistor 7 with a sheet resistance of about 5 kΩ(resistance value for a square sheet having a thickness of 10 $\mu$m and a side length of 3 mm), the mixing ratio of the glass to the conductive substance is set at 85:15.

Conversely, for making a heating resistor 7 with a low resistance, the content of ruthenium oxide is set relatively high. Specifically, for making a heating resistor 7 with a sheet resistance of about 100Ω, the mixing ratio of the glass to the conductive substance is set at 55:45.

Subsequently, the mixture of titanium-oxide-doped ruthenium oxide powder with the glass powder is further mixed with a resin and a solvent to provide a resistor paste. For the resin, use may be made of ethyl cellulose resin for example. For the solvent, use may be made of a high-boiling-point solvent such as terpineol. Further, zirconium oxide and other filler may be added to the resistor paste as required. The filler functions to enhance the thermal stability of a finally obtained heating resistor 7.

In this way, the resistor paste is prepared. In this embodiment, titanium oxide powder is added to ruthenium oxide powder before ruthenium oxide powder is mixed with glass. This enhances the endurable power of the heating resistor 7. It is not clear why the endurable power of the heating resistor 7 is enhanced by the addition of titanium oxide. Presumably, it is because titanium having an insulating ability is incorporated into the crystalline structure of ruthenium oxide to increase the electric resistance of ruthenium oxide particles. Actually, it has been confirmed that the sheet resistance of the heating resistor 7 increases from 5 kΩ to 14 kΩ by the addition of titanium oxide.

In this way, the resistance of ruthenium oxide powder increases by the addition of titanium oxide. Therefore, in mixing the same with glass for preparing a resistor paste, even when the content of the conductive substance, i.e., ruthenium oxide relative to glass is increased, the resistance of the entire heating resistor 7 does not easily decrease. Therefore, as compared with the case where titanium oxide is not added to ruthenium oxide, a larger amount of ruthenium oxide can be mixed in adjusting the resistance of the heating resistor 7 to a target value. This is because the resistance of ruthenium oxide is increased in advance by the addition of titanium oxide. Therefore, it is possible to decrease the likelihood of breakdown of the heating resistor 7 while enhancing the endurable power, so that the life of the heating resistor 7 can be prolonged. The heating resistor 7 thus prepared can be suitably used in a thermal printhead for high-speed printing in which heating and cooling are frequently repeated.

Figure 6:
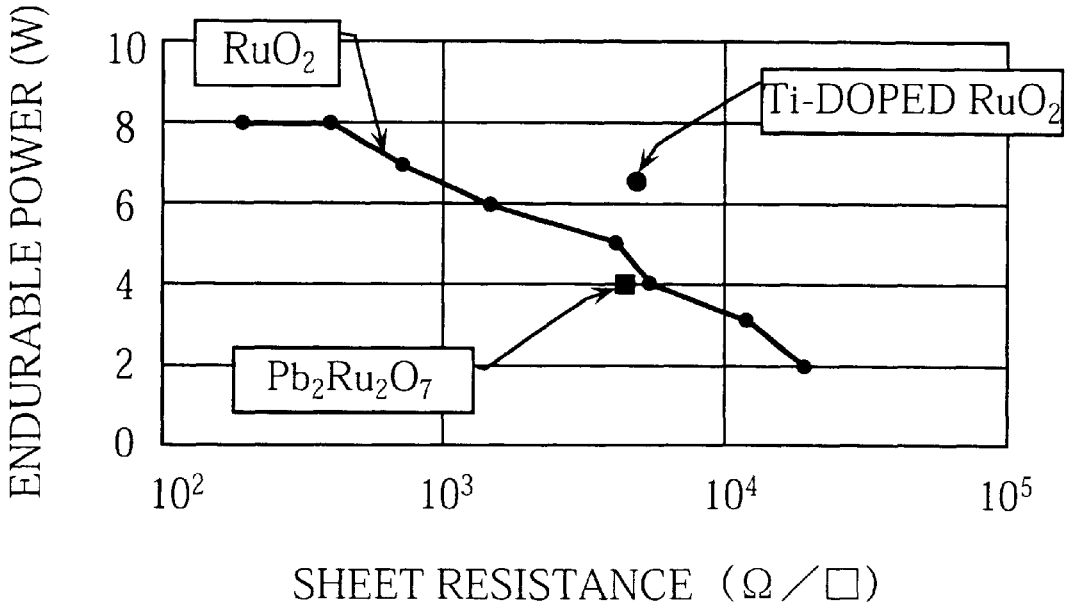
FIG. 6 is a graph showing the relationship between endurable power and sheet resistance in the case where ruthenium oxide alone or titanium-oxide-doped ruthenium oxide is used as a conductive substance.

FIG. 6 is a graph showing the relationship between endurable power and sheet resistance with respect to a conductive substance containing ruthenium oxide alone and with respect to a conductive substance containing titanium-oxide-doped ruthenium oxide (Ti-DOPED $RuO_2$ in the figure). As can be seen from this figure, the conductive substance containing ruthenium oxide alone provides lower endurable power as the sheet resistance increases. However, given an equal sheet resistance, titanium-oxide-doped ruthenium oxide exhibits higher endurable power.

Moreover, by adding titanium oxide powder to ruthenium oxide powder, the mixing amount of ruthenium oxide in preparing the resistor paste can be increased, so that it is possible to suppress localization of ruthenium oxide particles. Therefore, the glass and the conductive substance can be dispersed evenly, which prevents minus drift which often occurs in the case where the glass and the conductive substance are not dispersed evenly. As a result, a thermal printhead may be provided which operates reliably without deteriorating the printing quality.

In the above-described process of making a resistor paste, it may be also considered to mix ruthenium oxide with titanium oxide after ruthenium oxide is mixed with glass and provisionally baked. In this case, however, it is not possible to enhance the endurable power of the heating resistor. This is considered attributable to the fact that when ruthenium oxide is mixed with glass, particles of ruthenium oxide enter between glass particles to establish a strong bond with glass particles, consequently leaving no room for subsequently added titanium oxide to combine with ruthenium oxide.

Returning to FIG. 4, the resistor paste prepared in the above-described manner is printed on the substrate 1 in the form of a strip, dried, and baked at a temperature of 800–850° C. to provide a heating resistor 7. The solvent is evaporated by the baking. As a result, a hardened heating resistor 7 consisting of a mixture of Ti-doped ruthenium oxide and glass is obtained.

Subsequently, a protective film paste containing an abrasion-resistant material (for example glass) is printed on the heating resistor 7 in the form of a strip and is then baked at about 400° C. to provide a protective layer 8.

Then, a predetermined number of drive ICs 9 are mounted on the glaze layer 2 on the substrate 1, and the drive ICs 9 and the individual electrodes 4 are connected via wires 10. As a result, the thermal printhead having the above-described structure is obtained.

Although the use of Ti-doped ruthenium oxide can increase the number of conductor paths and enhance the endurable power of the heating resistor 7, an excessively high content of titanium oxide may adversely affects the trimming characteristics.

Figure 7:
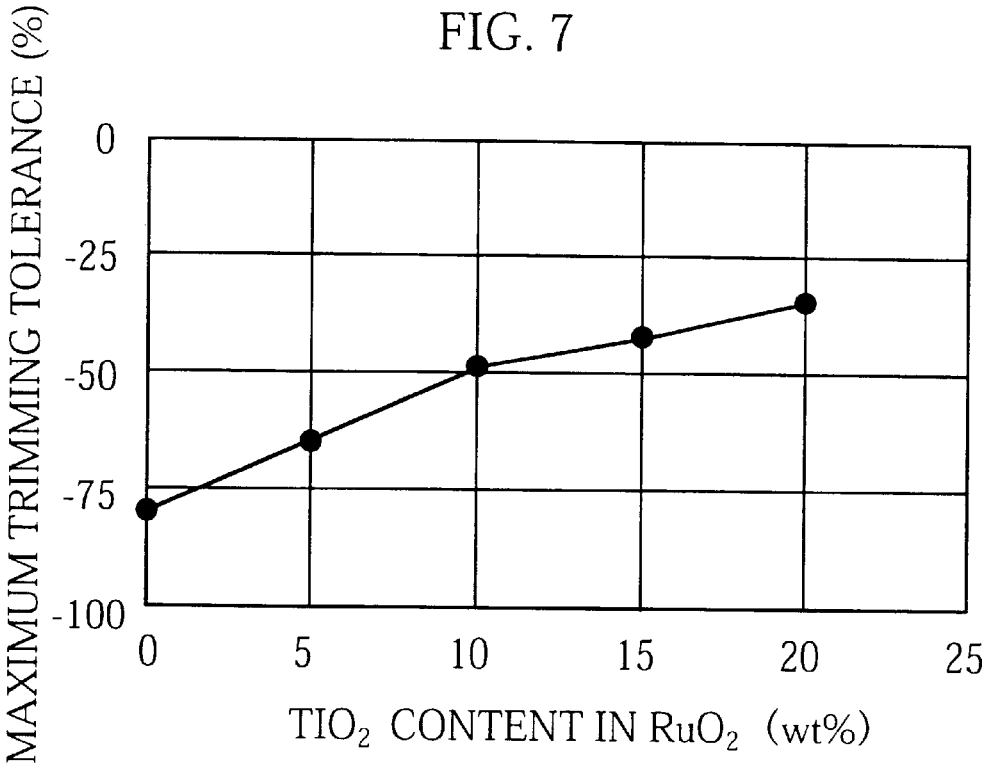
FIG. 7 is a graph showing the pulse trimming characteristics of a heating resistor.

FIG. 7 is a graph showing the pulse trimming characteristics of the heating resistor 7. This FIG. shows the maximum trimming drop (%) at a given content of titanium oxide in ruthenium oxide (more accurately, the content of titanium oxide in the mixture of ruthenium oxide and titanium oxide). As can be seen from this figure, as the content of titanium oxide increases, the maximum trimming drop increases; i.e., the trimming capacity deteriorates. It is preferable that the maximum trimming drop is no more than-50%. Therefore, from FIG. 7, it is found that a preferred content of titanium oxide is no more than 10 wt %.

Figure 8:
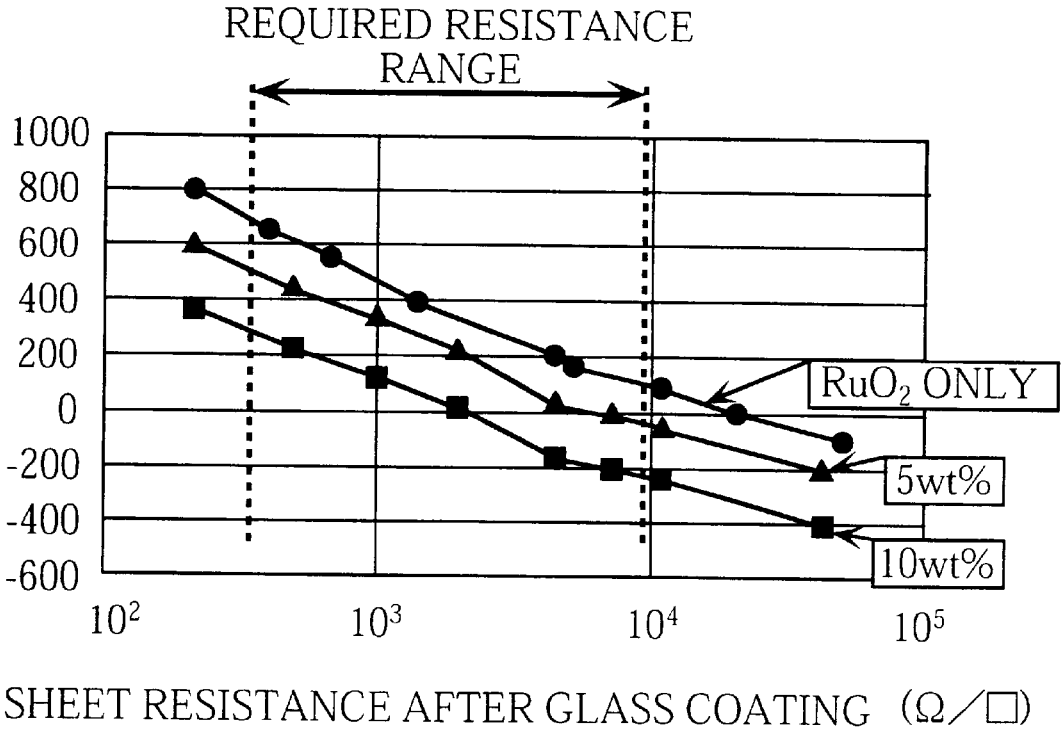
FIG. 8 is a graph showing the relationship between weight ratio of titanium oxide and temperature coefficient of resistance.

FIG. 8 illustrates the relationship between temperature coefficient of resistance (TCR) and sheet resistance in the cases where ruthenium oxide alone, doped ruthenium oxide containing 5 wt % of titanium oxide, doped ruthenium oxide containing 10 wt % of titanium oxide are used as a conductive substance. As can be seen from this figure, as the sheet resistance increases, the temperature coefficient of resistance decreases. Further, at a given sheet resistance, the higher the content of titanium oxide is, the lower the temperature coefficient of resistance is. Here, a sheet resistance within a range of 350 Ω–9 kΩ/□(□ means sheet) is required for use in a thermal printhead (the required resistance for the entire heating resistor 7 is within a range of 200 Ω–1 kΩ.), and the temperature coefficient of resistance becomes negative in a certain high-resistance range. Taking the above into consideration, the suitable content of titanium oxide is found to be no more than 5%. Thus, in view of the trimming characteristics, the suitable content of titanium oxide is 1–10 wt %, preferably 1–5 wt %, as described above.

Figure 9:
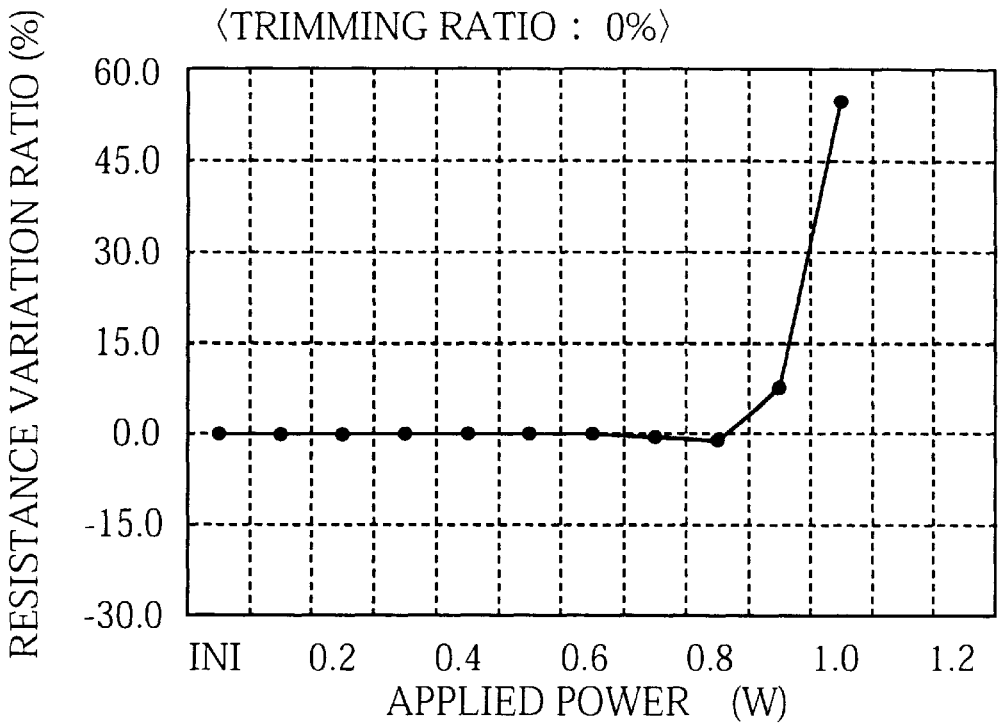
FIG. 9 is a graph showing the relationship between applied power and resistance variation ratio in the case where trimming ratio is 0%.
Figure 10:
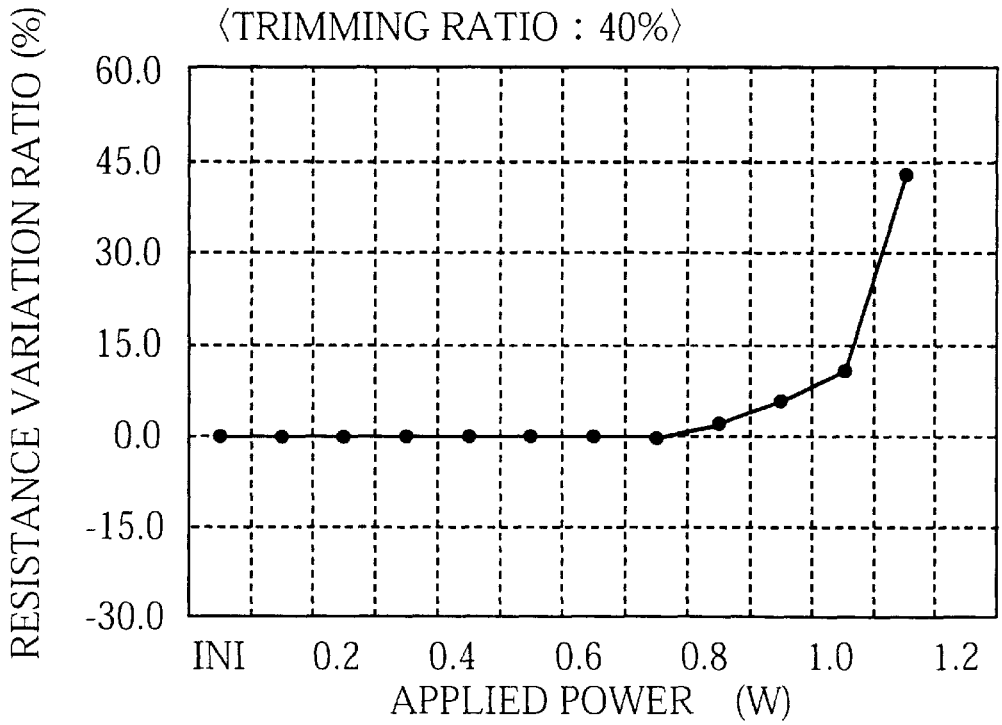
FIG. 10 is a graph showing the relationship between applied power and resistance variation ratio in the case where trimming ratio is 40%.

Moreover, from the experimental results shown in FIGS. 9 and 10, it is found that the mixing of titanium oxide with ruthenium oxide in preparing a resistor paste makes it possible to prevent a minus drift regardless of the trimming ratio. With the prior art method, it is not possible to prevent such a minus drift without conducting trimming which provides a resistance variation ratio of no less than 50%.

FIGS. 9 and 10 illustrate the relationship between applied power and resistance variation ratio in SST when a heating resistor is activated for 32 dots as discussed in the description of the prior art heating resistor. FIG. 9 illustrates the case where the trimming ratio is 0%, whereas FIG. 10 illustrates the case where the trimming ratio is 40%.

As shown in FIGS. 9 and 10, the minus drift does not occur in both cases where the trimming ratio is 0% and the trimming ratio is 40%. Therefore, in the heating resistor 7 of this embodiment, it is possible to reliably prevent the minus drift without depending on the trimming ratio.

Of course, the present invention is not limited to the above-described embodiments. For example, the conductive substance and the insulating substance contained in the heating resistor or the value of electric resistance are not limited to those described in the embodiments. For example, instead of utilizing ruthenium oxide, salt of ruthenium oxide or indium oxide may be utilized as a conductive substance. Further, the insulating substance is not limited to titanium oxide. Instead, another conductive substance having a rutile crystalline structure may be used.

What is claimed is:

1. A heating resistor for a thermal printhead, the heating resistor containing a conductive substance and glass, wherein the conductive substance is doped with an insulating substance which is identical in crystalline structure to the conductive substance, the insulating substance being incorporated into the crystalline structure of the conductive substance.

2. The heating resistor for a thermal printhead according to claim 1, wherein the conductive substance comprises ruthenium oxide.

3. The heating resistor for a thermal printhead according to claim 2, wherein the insulating substance comprises titanium oxide.

4. The heating resistor for a thermal printhead according to claim 3, wherein the titanium-oxide-doped ruthenium oxide contains 1–10 wt % of titanium oxide.

5. A thermal printhead comprising a substrate, an electrode layer formed on the substrate, and a heating resistor which is formed on the electrode layer, the heating resistor containing a conductive substance and glass, wherein the conductive substance is doped with an insulating substance which is identical in crystalline structure to the conductive substance, the insulating substance being incorporated into the crystalline structure of the conductive substance.

6. The thermal printhead according to claim 5, wherein the conductive substance comprises ruthenium oxide.

7. The thermal printhead according to claim 6, wherein the insulating substance comprises titanium oxide.

8. The heating resistor for a thermal printhead according to claim 7, wherein the titanium-oxide-doped ruthenium oxide contains 1–10 wt % of titanium oxide.

9. A process of making a heating resistor for a thermal printhead, comprising the steps of:

preparing a resistor paste by mixing powder of a conductive substance and glass powder;

printing the resistor paste into a film; and baking the printed resistor paste;

wherein, before mixing the conductive substance powder with the glass powder, the method further comprising the steps of:

mixing powder of an insulating substance with the conductive substance powder, the insulating substance being identical in crystalline structure to the conductive substance;

baking the obtained mixture; and pulverizing the baked mixture.

10. The process according to claim 9, wherein the conductive substance comprises ruthenium oxide.

11. The process according to claim 10, wherein the insulating substance comprises titanium oxide.

12. The process according to claim 11, wherein the titanium-oxide-doped ruthenium oxide contains 1–10 wt % of titanium oxide.

* * * * *